United States Patent [19]

De Mund

[11] 4,006,798

[45] Feb. 8, 1977

[54] DRIVE-UP SERVICE ARRANGEMENT FOR BANKS, AND THE LIKE

[76] Inventor: Fred W. De Mund, Box 612, Morgantown, W. Va. 26505

[22] Filed: Mar. 29, 1976

[21] Appl. No.: 671,714

[52] U.S. Cl. ..... 186/1 C; 52/79.9; 186/1 R

[51] Int. Cl.[2] ..... E04H 3/04

[58] Field of Search ..... 186/1 C, 1 R; 52/79

[56] References Cited

UNITED STATES PATENTS

| | | | |
|---|---|---|---|
| 2,089,058 | 8/1937 | Harley | 52/79 |
| 3,077,243 | 2/1963 | Buros | 186/1 C |
| 3,292,327 | 12/1966 | Van der Lely | 52/79 |
| 3,647,026 | 3/1972 | Alexander | 186/1 C |
| 3,905,167 | 9/1975 | Watkins | 52/79 |
| 3,955,328 | 5/1976 | Lindsay | 52/79 |

*Primary Examiner*—Trygve M. Blix
*Assistant Examiner*—Reinhard J. Eisenzopf
*Attorney, Agent, or Firm*—Karl W. Flocks

[57] ABSTRACT

An extensible overhead personnel enclosure compartment assembly forming a drive-in transaction annex to a building proper. The enclosure assembly comprising a plurality of compartment modules each of which includes male and female end portions for plug-in interconnection with adjacent modules to form said extensible assembly.

12 Claims, 4 Drawing Figures

12
41
39
11
10'
12'
11
10

14
12
10
22
35
30
33
28
20
17
31
18
26

DRIVE-UP SERVICE ARRANGEMENT FOR BANKS, AND THE LIKE

BACKGROUND OF THE INVENTION

1. Field of the Invention

The present invention relates to a drive-up transaction arrangement and particularly to an arrangement servicing a plurality of vehicle lanes for banking purposes or the like.

2. Description of the Prior Art

Drive-in arrangements are well know in the prior art, among which the more commonly known are those in the quick service food business, such as drive-in restaurants. In such arrangements service is usually provided by "car hops" and the customer generally must back out of the service area instead of driving through it.

In other prior art drive-in transaction arrangements, service is frequently provided by tellers enclosed in service counters at ground level so that the most advantageous use of ground space is not taken into account.

A disadvantage of other prior art arrangements lies in the fact that visual confrontation is not always afforded between the parties of the transactions.

Examples of prior art drive-in service arrangements of the general types hereinabove described are disclosed in the following U.S. Pat. Nos. 1,819,806; 3,077,243 and 3,556,437.

SUMMARY OF THE INVENTION

The present invention comprises a new and improved drive-in service arrangement which affords the most economical use of available ground space. The improved drive-in arrangement according to the present invention generally comprises one or more overhead servicing compartments from which a protected attendant or teller may transact business remotely with drive-in customers in at least two lanes therebelow. An additional object of this invention is to provide a remote transaction arrangement in which there is visual contact between the parties to the transaction.

Still another object of this invention is to provide a drive-in service arrangement in which the service compartments enclosing the teller or attendant comprise prefabricated plug-in modules which may be conveniently extended or terminated in a line.

A further object of this invention is to provide a drive-in service arrangement which may if desired be quickly disassembled and moved or re-arranged.

Still further objects of the present invention are to provide an improved service arrangement for remote transactions which is of rugged and durable construction and yet require a minimum of time and effort in assembling and/or re-arranging, and which is otherwise particularly well adapted for its intended purpose.

DETAILED DESCRIPTION OF THE PREFERRED EMBODIMENT

Figure 1:
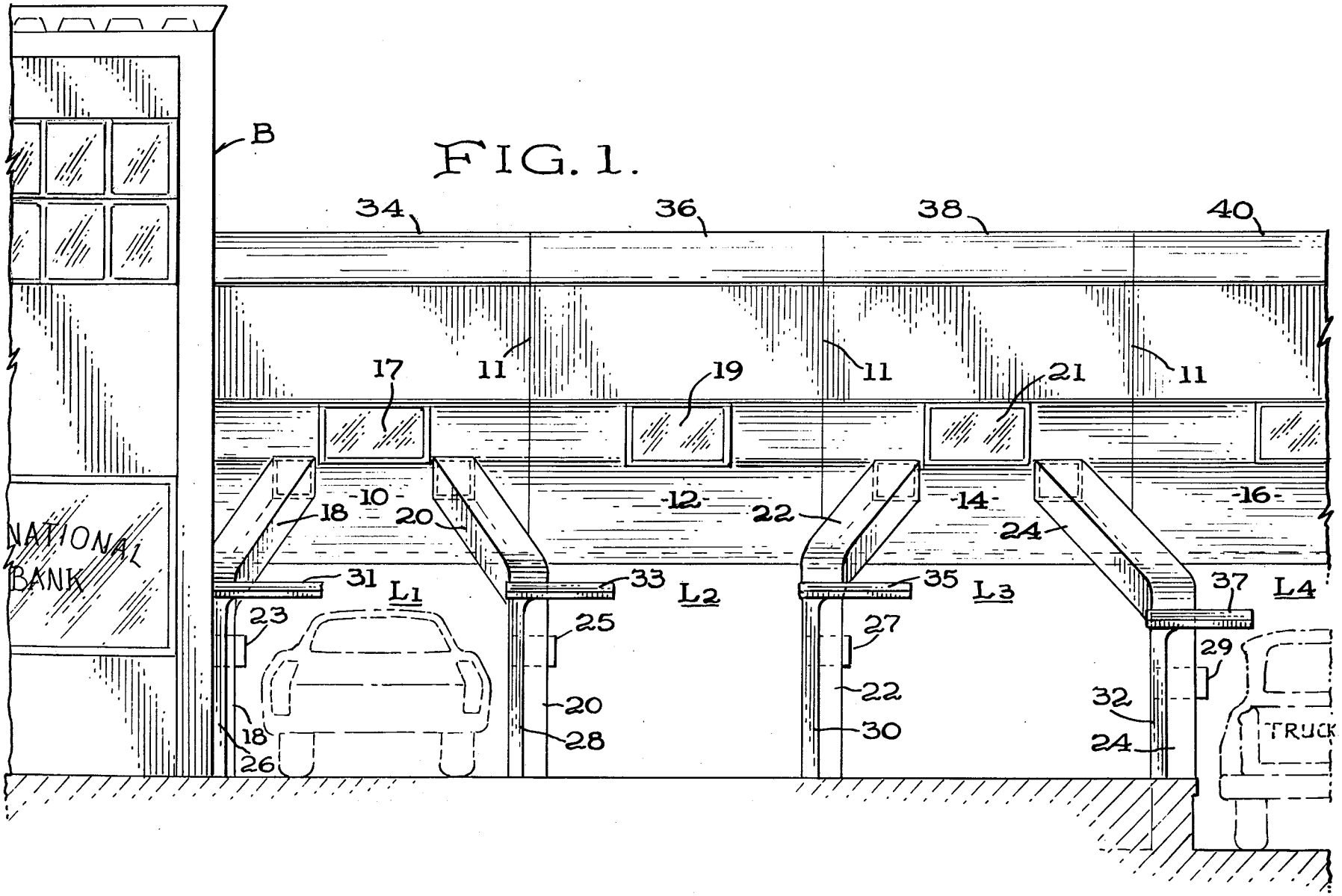
FIG. 1 is a front elevational view of the preferred arrangement according to this invention.
Figure 2:
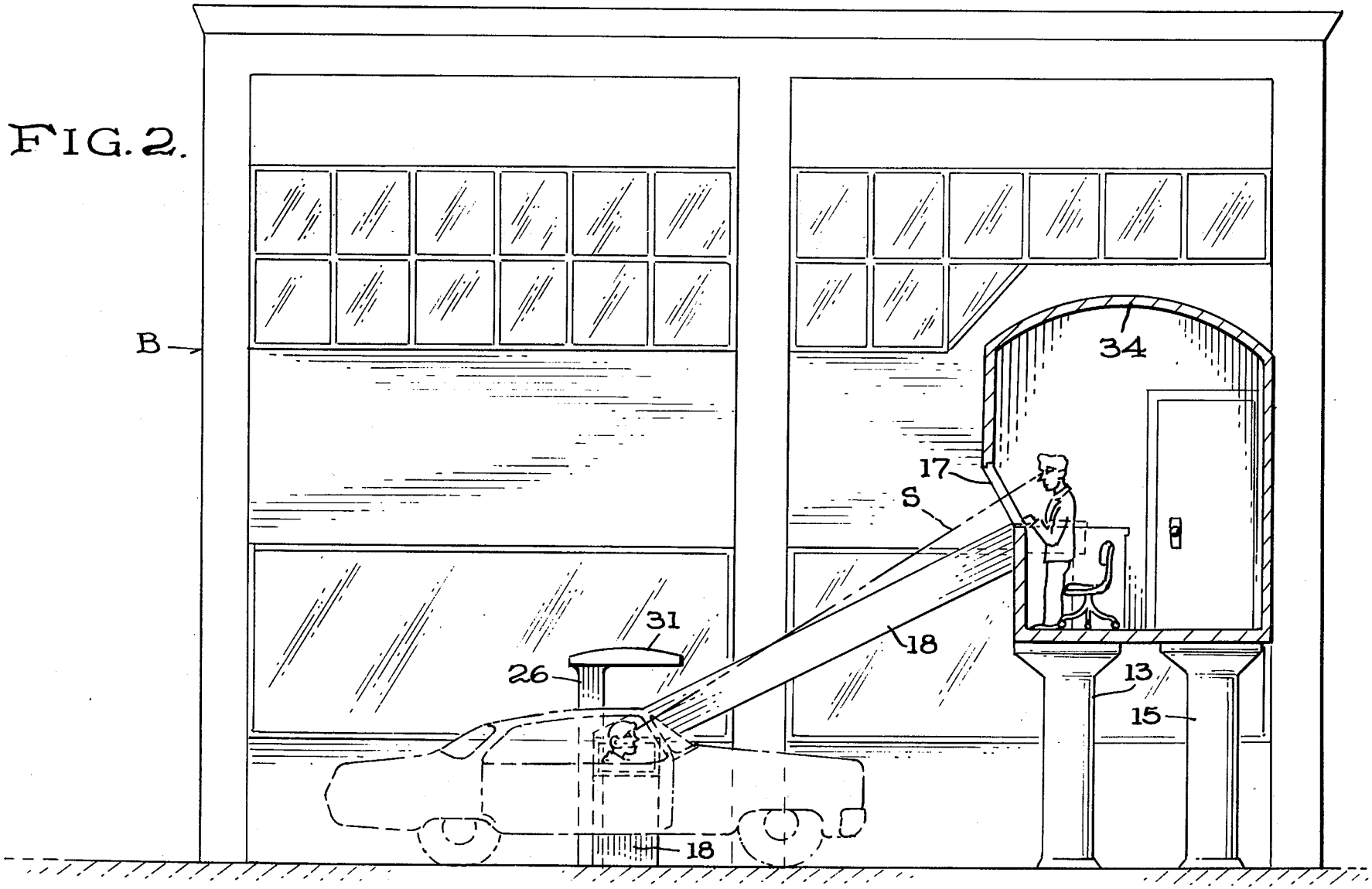
FIG. 2 is an elevational view of the arrangement according to FIG. 1 taken along a transverse section of one of the compartments in the arrangement.
Figures 3, 4:
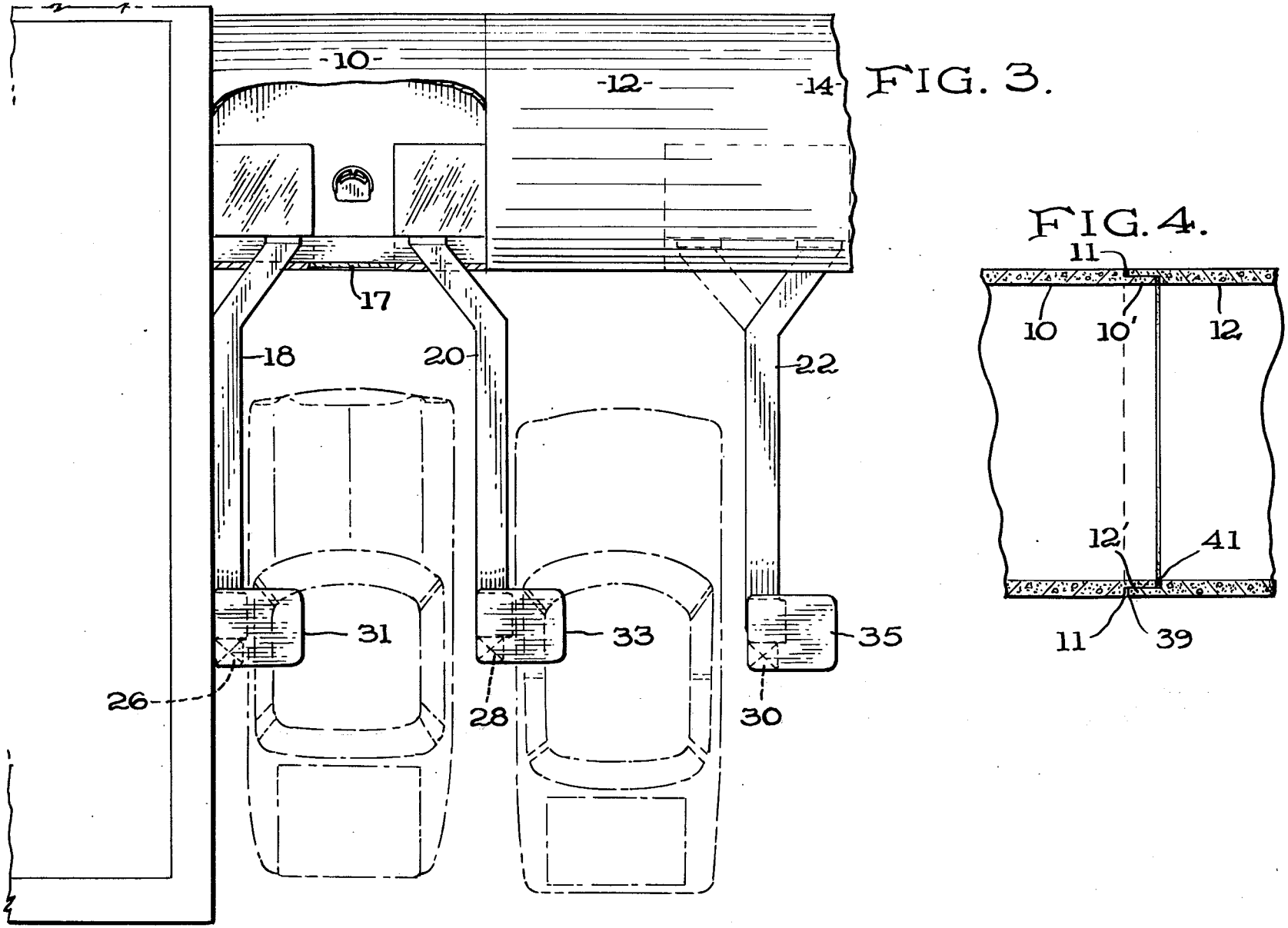
FIG. 3 is a plan view of the arrangement shown in FIG. 1 with portions thereof broken away.
FIG. 4 is a longitudinal section view through a pair of interconnected compartments showing details of the interconnected end portions thereof.

Referring now more particularly to the drawing the assembled compartments according to this invention form a service arrangement, as shown in FIGS. 1–3, which is adapted, in particular, for use in conducting banking transactions with drive-in customers, although it may be equally well adapted to other types of service including the merchandising of goods, dispensing of food, and the like. Thus as shown in FIG. 1, a first compartment module 10 is seen to be annexed to a bank building B proper. Interconnected to the first compartment module 10 in an extensible chain are a series of compartment modules 12, 14, and 16. The modules 10, 12, 14 and 16 are delineated from each other in FIG. 1 by the line 11 and are arranged above ground level to permit the passage of customer vehicles in lanes L1, L2, L3 and L4, respectively, formed therebelow. Each compartment module is supported above ground level by columns 13 and 15, such as shown in FIG. 2, which preferably are of prefabricated reinforced concrete or like material. Each of the compartment modules 10, 12, 14 and 16 are made of completely armored material and include transparent windows 17, 19, 21, etc., which are of armored plate glass.

A pair of conveyor chutes 18 and 20 are interconnected to module 10 and extend downwardly and forwardly therefrom to ground level at lanes L1 and L2. Pull-out drawers 23 and 25 are provided in the vertical extensions of chutes 18 and 20, respectively, generally at the window level of customer vehicles. Similarly, conveyor chutes 22 and 24 extend downwardly and forwardly from compartment module 14 and include pull-out drawers 27 and 29, respectively, in the vertical extensions thereof. Although conveyor chutes 18 and 20 are equipped on compartment module 10, they may instead be located in conjunction with compartment module 12. Similarly, conveyor chutes 22 and 24 may be connected to compartment module 16 instead of to compartment module 14. Thus, as shown in FIG. 3, conveyor chute 22 may also be attached to compartment module 12 as shown in phantom instead of to compartment module 14, in which case module 14 would only have chute 24 extending therefrom.

The chain of compartment modules, which as shown in FIG. 1, includes modules 10, 12, 14 and 16 may be terminated by the omission of module 16 therefrom. With module 16 omitted from this chain the remaining modules 10, 12 and 14 will be adequate to service the lanes L1, L2, L3 and L4. The lane L4, as shown in FIG. 1, is specially constructed at a lower level than lanes L1, L2 and L3 to provide adequate clearance and thus accommodate trucks and other vehicles larger than conventional passenger cars.

Extending vertically and in front of the vertical portion of conveyor chute 18 is a support beam 26 at the top of which extends a cantilevered supported shield 31 which shelters the pull-out drawer 23 from rain, snow, and the like. Similar support beams 28, 30 and 32 provide shields 33, 35, and 37 over pull-out drawers 25, 27 and 29, respectively.

Compartment module 10 includes an arched roof 34 as shown in FIG. 2. Similarly arched roofs 36, 38, and 40 are provided on compartment modules 12, 14 and 16, respectively.

As mentioned above each of the compartment modules include male and female end portions on opposite ends thereof with the male end portion 10' of compartment module 10 telescopically interfitted within female end portion 12' of compartment module 12 as shown in FIG. 4. Appropriate seal elements 39 and 41 may be placed in the area defined by the line of separation 11, for example, in the vicinity between the shoulders and extreme edges of the end portions 10' and 12', respectively.

To carry out a transaction with a teller in compartment module 10, for example, a bank customer may drive up to pull-out drawer 23, pull out the drawer 23, insert his cash or check, and close the drawer 23. The teller in compartment module 10 whose line of sight S allows him to visually confront the customer seated in his car may then activate the conveyor mechanism within chute 18 to gain access to the customer's business and make whatever change or return to the customer by any conventional conveyor means. As a further matter of convenience, an intercom system may be provided for conversation between the participants of the transaction. While one teller or attendant may service two lanes, the compartment module 10, for example, has adequate room for two attendants in the event that more than one attendant is desired in a service module during peak business hours.

The prefabricated compartment modules as described above thus may be conveniently brought on the site, easily moved, arranged and assembled. Further, the assembly of compartment module chain may be easily extended or shortened as desired. In practice each module may be aptly made approximately eight feet deep by nine or ten feet long. Suitable securing means such as bolts located internally of the compartments, for example, may be applied to lock the plug-in end portions to each other. Alternatively, heavy duty clamping means may be provided to lock the assembled modules together.

Although I have described my invention with a certain degree of particularity, it is understood that the present disclosure has been made only by way of example and that numerous changes and details may be resorted to without departing from the spirit and scope of the invention as hereinafter claimed.

I claim:

1. An extensible chain arrangement of personnel enclosures comprising a plurality of interconnected cell modules, a first module of said chain securely attachable to a building proper and including passageway therebetween, additional ones of said modules being successively and securely attached to said first module and to each other to thereby form said chain including passageway therethrough, and means supporting said chain above ground level whereby a plurality of motor vehicle lanes are formed for passage of vehicles thereunder, with at least one of said modules being equipped with a conveyor means extending forwardly and down to ground level whereby transactions may be carried out between at least one of said modules and occupants of vehicles in separate lanes at ground level.

2. The arrangement as recited in claim 1 wherein each of said modules is formed of completely armored material and includes a transparent pane through which an occupant may visually confront the occupants of vehicles during the course of a transaction.

3. The arrangement as recited in claim 2 wherein said transparent pane is of armored plate glass.

4. The arrangement as recited in claim 1 wherein each of said modules comprise male and female portions on opposite ends thereof whereby adjacent ends of successive modules are arranged in interconnected, plugged-in telescopic relationship.

5. The arrangement as recited in claim 1 wherein said means supporting said chain comprise prefabricated reinforced concrete or other suitable material.

6. The arrangement as recited in claim 1 wherein said conveyor means comprise separate chutes extending forwardly and down to each lane to be serviced thereby with said separate chutes each including a pull-out drawer readily accessible to the driver of a vehicle stopped at a transaction position.

7. The arrangement as recited in claim 6 wherein shield means are provided over each of said drawers to thereby protect it from rain, snow or the like.

8. The arrangement as recited in claim 1 wherein the number of lanes to be serviced by said chain of interconnected modules exceed the number of said modules by at least one.

9. The arrangement as recited in claim 8 wherein at least one of said lanes is formed at a slightly lower level than other of said lanes to afford adequate clearance for larger size vehicles to be serviced.

10. The arrangement as recited in claim 1
wherein each of said modules is prefabricated of completely armored material with male and female plug-in portions on opposite ends thereof whereby said modules may be brought on site ready for plug-in installation, quickly set up, disassembled, moved or rearranged.

11. The arrangement as recited in claim 1 wherein said at least one of said modules from which transactions may be carried out with occupants of vehicles in separate lanes at ground level is equipped with a transparent pane situated between drivers of vehicles in said separate lanes to provide a teller in said at least one of said modules with a clear line of sight to drivers to be serviced in both of said separate lanes.

12. An elevated enclosure securely attached to a building proper and including a passageway therebetween, said enclosure being sufficiently elongated to extend over a plurality of motor vehicle lanes and of such width and height as to accommodate personnel serving customers in vehicles in said lanes, said enclosure having transparent panes facing approaching vehicles in said lanes, conveyor means extending forwardly and downwardly from the enclosure to a side of each of said lanes whereby transactions can be carried out between the occupants of the vehicles and the personnel in the enclosure, means for supporting said enclosure at such an elevation that vehicles may pass under the enclosure and that personnel in the enclosure may visually confront an occupant of a vehicle in one of said lanes.

* * * * *